US005642092A

United States Patent [19]

Dunne et al.

[11] Patent Number: 5,642,092

[45] Date of Patent: Jun. 24, 1997

[54] EVACUATION ASSISTANCE SYSTEM

[76] Inventors: Grace Dunne, 883 Washington St., Gloucester, Mass. 01930; Kathleen M. Stanton, 16 Bayard St., Allston, Mass. 02134

[21] Appl. No.: 549,025

[22] Filed: Oct. 27, 1995

[51] Int. Cl.[6] ..... G08B 27/00

[52] U.S. Cl. ..... 340/326; 340/328; 340/331; 340/573

[58] Field of Search ..... 340/326, 328, 340/330, 331, 332, 333, 628, 286.05, 293, 573

[56] References Cited

U.S. PATENT DOCUMENTS

| | | | |
|---|---|---|---|
| 2,628,347 | 2/1953 | Foster, Sr. | 340/326 |
| 3,969,720 | 7/1976 | Nishino | 340/326 |
| 4,074,225 | 2/1978 | Vandeweghe | 340/628 |
| 4,148,023 | 4/1979 | Elkin | 340/326 |
| 4,283,657 | 8/1981 | Gordon et al. | 340/331 |
| 4,385,586 | 5/1983 | Schriever | 340/331 |
| 4,531,114 | 7/1985 | Topol et al. | 340/628 |
| 4,539,555 | 9/1985 | Tefka | 340/628 |
| 4,612,535 | 9/1986 | Sequin et al. | 340/628 |
| 4,837,560 | 6/1989 | Newberry | 340/628 |
| 5,177,461 | 1/1993 | Budzyna et al. | 340/331 |

FOREIGN PATENT DOCUMENTS

| | | | |
|---|---|---|---|
| 2214681 | 6/1989 | United Kingdom | 340/326 |

*Primary Examiner*—Brent A. Swarthout
*Assistant Examiner*—Van T. Trieu
*Attorney, Agent, or Firm*—Daniel J. Bourque; Kevin J. Carroll

[57] ABSTRACT

An automatic evacuation assistance system, for assisting animals or people in existing a structure includes an event detector, such as a smoke detector for providing an event detection signal. The event detection signal is received by an exit control device which is coupled to an exit opening, for allowing the exit opening to open, providing an exit path to the outside of a structure. A sensory attractant transmitter transmits a sensory attractant in the form of a sound, smell, or visual signals to attract the person or animals to the exit path and exit opening.

20 Claims, 1 Drawing Sheet

EVACUATION ASSISTANCE SYSTEM

FIELD OF THE INVENTION

This invention pertains to an evacuation assistance system and more particularly, to a system for assisting the evacuation of animals and persons from a structure.

BACKGROUND OF THE INVENTION

A great many homes include pets of some kind. Dogs and cats by far make up the majority of household pets. Often these animals are left alone for a good portion of the day while their owners are out. Should a catastrophe, such as a fire, occur while no one is present, the animal is usually trapped inside and could needlessly die.

Catastrophe detection devices such as smoke alarms and gas leak detectors can detect dangerous situations very quickly. However, if all the detection devices do is sound an alarm, an animal who is home alone in a locked enclosure or structure is still trapped.

If the animal or animals had some means of exiting the structure, they can be saved. Several homes have pet doors, which allow the animals to enter and leave at will. Such egresses are not practical for house pets that normally remain inside at all times. Further, pet doors allow neighborhood animals and wild animals to enter the building. Accordingly, what is needed is an exit path which only opens when a catastrophe requiring the animals to exit occurs.

Even if an exit path automatically opens, however, the animal may not exit the structure. The animal may be sleeping, afraid or scared or may not realize that an exit is available in a certain part of the structure. If the animal is unaware that such an opening is available it will not know to proceed there in the event of a fire or other catastrophe.

Children or adults with mental impairments are also often confused about what steps to take in an emergency. A pre-recorded voice that coaxes the person to proceed to an exit would be extremely helpful.

Accordingly, what is needed is an automatic evacuation assistance system which in case of an emergency will provide an exit path along with some means of attracting a person or an animal to the exit path.

SUMMARY OF THE INVENTION

An automatic evacuation assistance system includes an event detector which is responsive to the occurrence of an event to provide an event detection signal. The event detection signal is received by an exit control device which is coupled to the event detector and also to an exit opening disposed in an exit path. The exit control device is responsive to the event detection signal and allows the exit opening to open.

A sensory attractant transmitter is disposed proximate the exit path and is responsive to the event detection signal produced by the event detector. The sensory attractant transmitter emits a sensory attractant, to attract animals or people to the exit path so they may exit safely.

The sensory attractant transmitter can be located inside or outside of the exit opening. Exit openings include windows, pet doors, regular doors, kennel doors, barn and stable doors, or any other opening for an enclosure containing house pets, farm animals or humans.

Events are any events which require the animal or person to leave the structure for safety. These events include fire, smoke, flood, earthquake, gas leak, and carbon monoxide leaks. Event detectors include detectors which detect any of the above events, including fire detectors, smoke detectors, earthquake detectors and gas or carbon monoxide leak detectors.

The sensory attractant transmitter may transmit any sensory attractant which may attract animals or persons. These sensory attractant transmitters can include sound producing devices including sound playback devices including pre-recorded sounds and predetermined human voices; scent producing devices including aerosol sprays; and visual image projectors.

DESCRIPTION OF THE DRAWING

These and other features and advantages of the present invention will be better understood by reading the following detailed description, taken together with the drawings wherein.

DETAILED DESCRIPTION OF THE PREFERRED EMBODIMENT

Figure 1:
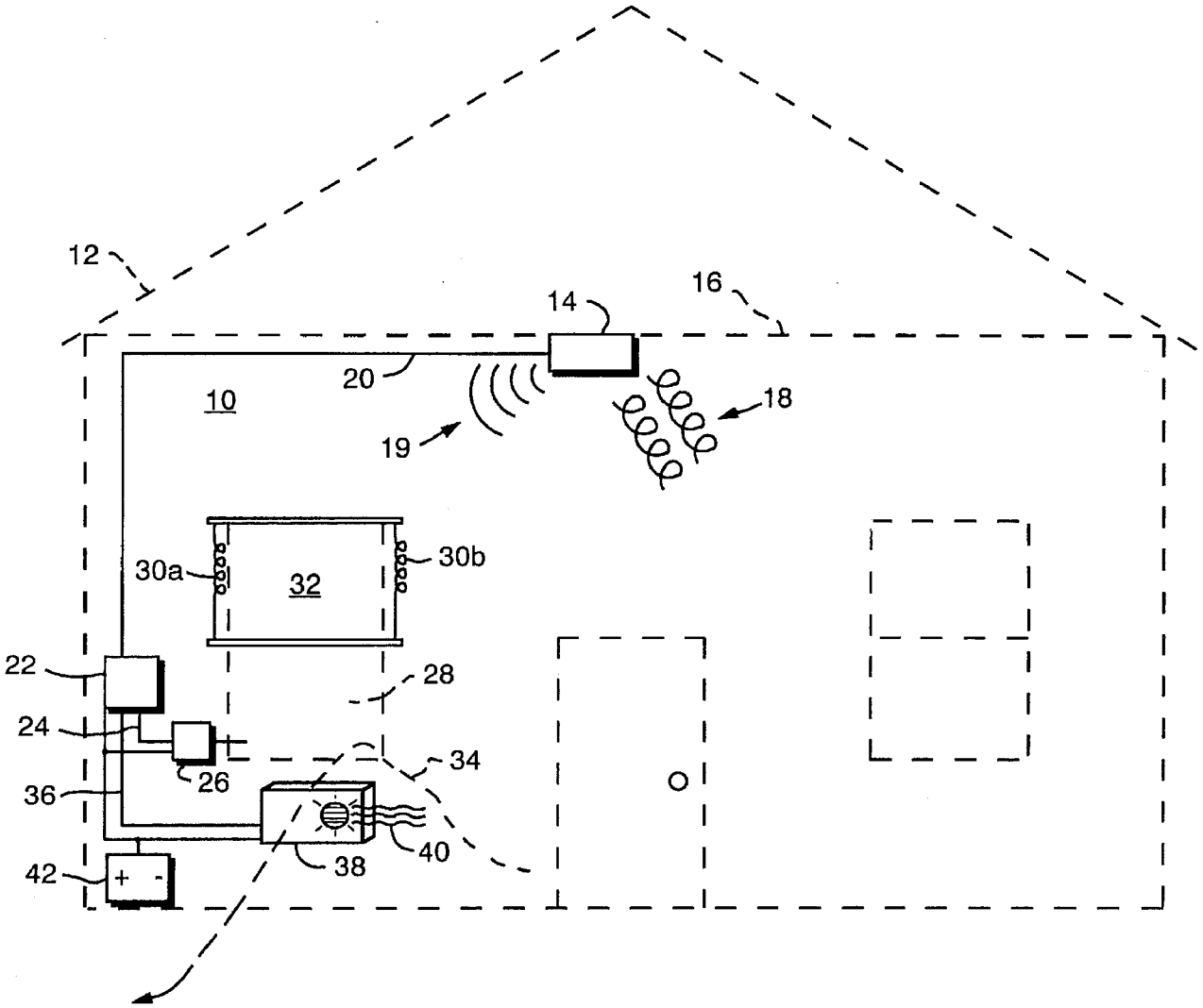
FIG. 1 is a schematic representation of a system for providing automatic evacuation assistance according to the present invention.

An automatic evacuation system 10, FIG. 1, according to the present invention can be mounted in any structure 12 including any house, building or other structure. An event detector 14 is mounted on a location such as ceiling 16 where event detector 14 can effectively monitor for the occurrence of an event 18. An event 18 includes any situation which requires the occupants of structure 12 to evacuate. Such events include fire, smoke, carbon monoxide leaks, gas leaks, floods and earthquakes. Examples of event detectors 14 include smoke detectors, heat and flame detectors, gas detectors, carbon monoxide detectors, water detectors, and earthquake detection devices.

Event detector 14 can be any standard event detection device provided on the market which can be rewired to provide an event detection signal 19 to event detection device 14. Conversely, a standard detector such as a smoke detector may be used where exit control device 22 is responsive to the sonic alarm emitted by event detector 14.

Event detector 14 provides an event detection signal 19 over event detection signal path 20 to exit control device 22. Event detection signal path 20 includes any means of transmitting a signal, including electrical wires, infrared signals, radio signals, audible or ultrasonic signals, or any combination thereof.

Upon receiving the event detection signal 14, exit control device 22 provides an exit opening activation signal 24 to activate exit opening 28. Exit opening 28 provides an exit path 34 allowing animals or people to exit structure 12.

In one embodiment, exit opening 28 includes a window pane. A release device 26 is responsive to the exit opening activation signal 24 from exit control device 22. Release device 26 releases sliding window pane 32. Release device 26 may include a solenoid or motor. Sliding window 32 may include springs or counterweights 30*a* and 30*b* which allow window pane 32 to rise when release device 26 release window pane 32.

Other examples of exit openings 28 include doors with automatic door latches, special openings for animals such as pet openings in doors, and cage doors for animals kept in cages or enclosures inside structure 12.

Exit control device 22 also provides an attractant activation signal 36 to sensory attractant transmitter 38 which forms part of the present invention. One or more sensory attractant transmitter 38 may be located anywhere along exit path 34 to attract the animal or person towards exit opening 28. Therefore, sensory attractant transmitter 38 can be mounted outside structure 12 as shown in FIG. 1, and/or inside proximate exit opening 28.

Sensory attractant transmitter 38, upon receiving the attractant activation signal 36, transmits an attractant 40 to attract the animals or persons inside structure 12 to exit path 34. Attractant 40 includes any type of attractant which will get the attention of the animals or persons inside structure 12. Such attractants include sounds, smells, visual signals and combinations thereof.

Attractant sounds can be produced by a pre-recorded tape or record, or synthesized by an electronic device. Some examples of attractant sounds which work for animals such as dogs or cats include birds chirping, insect buzzing, dog barking, mating cat calls, keys rattling, paper rattling, can opener clicking noises, bells, chimes or any other similar noises or activities. The sounds can also be personal including voice recordings of the master or parent, or standard recordings including the time honored "Here, kitty, kitty, kitty". As pets are all different, a system which allows an owner to record a specialized sound which is an effective attractant peculiar to that animal is very helpful.

For attracting people to exit opening 28, other sounds may be used including a familiar voice of the parent or guardian, asking the person to come to and go out the exit.

Sensory attractant transmitters 38 which produce smells include an aerosol spray or other means of dispensing smells such as fish, meat, mouse or spices including catnip, apples, sugar, cinnamon, or other pleasing odors. The sensory attractant transmitter 38 can also include a small fan (not shown) to blow such odors into exit opening 28 to attract the animals.

Sensory attractant transmitters 38 which transmit visual signals can include projecting shadows such as insects or other fast moving visuals which attract dogs or cats, a blowing flag, or flashing of colored lights. Any combination of the above examples can be combined to provide a more effective signaling device.

Exit control device 22, exit opening device 26 and sensory attractant transmitter 38 can include an alternate power supply 42 in case of power failure to the main power supply in structure 12.

Accordingly, the present invention provides an automatic system always ready to assist animals or person in evacuating a structure in an emergency. The automatic evacuation system 10 is easy to construct with readily available parts.

Modifications and substitutions by one of ordinary skill in the art are considered to be within the scope of the present invention which is not to be limited except by the claims which follow.

What is claimed is:

1. An automatic evacuation system comprising:

an event detector, responsive to the occurrence of an event, for providing an event detection signal;

an exit control device, coupled to said event detector and to an exit opening disposed in an exit path, said event control device responsive to said event detection signal, for allowing said exit opening to open; and a scent producing device, disposed proximate said exit path and responsive to said event detection signal, for emitting a scent attractant.

2. The system of claim 1, wherein said sensory attractant transmitter is located inside said exit opening.

3. The system of claim 1, wherein said sensory attractant transmitter is located outside said exit opening.

4. The system of claim 1, wherein said event is selected from the group of fire, smoke, flood, earthquake, gas leak, and carbon monoxide leak.

5. The system of claim 1, wherein said event detector includes a smoke detector.

6. The system of claim 1, wherein said event detector includes a flame detector.

7. The system of claim 1, wherein said exit opening includes a window.

8. The system of claim 1, wherein said exit opening includes a pet door.

9. The system of claim 1, wherein said sensory attractant transmitter includes a sound producing device.

10. The system of claim 9, wherein said sound producing device includes a sound playback device including prerecorded sounds.

11. The system of claim 10, wherein said pre-recorded sounds include predetermined human voice sounds.

12. The system of claim 1, wherein said scent producing device transmits a scent attractive to at least one pet.

13. The system of claim 1, wherein said sensory attractant transmitter includes a visual image projector.

14. The system of claim 1, wherein said exit control device opens said exit opening.

15. An automatic evacuation system comprising:

an smoke detector, for providing a smoke detection signal;

an exit control device, coupled to said smoke detector and to an exit opening disposed in an exit path, said exit control device responsive to said smoke detection signal, for allowing said exit opening to open; and a scent producing device, disposed proximate said exit path and responsive to said smoke detection signal, for emitting a sensory attractant.

16. A method for evacuating pets from a structure, comprising the steps of:

detecting an occurrence of an event;

opening an exit opening allowing the pet to exit the structure, in response to the detection of the occurrence of the event; and transmitting a pet scent attractant proximate the exit opening.

17. The method of claim 16, wherein the step of detecting an occurrence of an event includes detecting a fire.

18. The system of claim 16, wherein the step of opening an exit opening includes opening a pet door, in response to the detection of the occurrence of the event.

19. The system of claim 16, wherein the step of transmitting a pet sensory attractant includes transmitting a scent attractive to a pet.

20. The system of claim 19, further including the step of circulating said scent attractive to the pet throughout the structure.

* * * * *